US005128023A

United States Patent [19]

Reid et al.

[11] Patent Number: 5,128,023

[45] Date of Patent: * Jul. 7, 1992

[54] METHOD FOR INHIBITING COKE FORMATION AND DEPOSIITON DURING PYROLYTIC HYDROCARBON PROCESSING

[75] Inventors: Dwight K. Reid, Houston; Daniel E. Fields, The Woodlands, both of Tex.

[73] Assignee: Betz Laboratories, Inc., Trevose, Pa.

[ * ] Notice: The portion of the term of this patent subsequent to Aug. 13, 2008 has been disclaimed.

[21] Appl. No.: 676,044

[22] Filed: Mar. 27, 1991

[51] Int. Cl.[5] ..... C10G 9/16

[52] U.S. Cl. ..... 208/48 Q; 208/48 AA; 208/48 R; 208/47

[58] Field of Search ..... 208/48 Q, 48 AA, 48 R, 208/47

[56] References Cited

U.S. PATENT DOCUMENTS

| | | | |
|---|---|---|---|
| 1,847,095 | 3/1932 | Mittasch et al. | 208/48 |
| 2,063,596 | 12/1936 | Feiler | 196/133 |
| 3,342,723 | 9/1967 | Godar | 208/48 |
| 3,531,394 | 9/1970 | Koszman | 208/48 |
| 3,661,820 | 5/1972 | Foreman et al. | 260/22 A |
| 3,687,840 | 8/1972 | Sze et al. | 208/131 |
| 4,555,326 | 11/1985 | Reid | 208/48 |
| 4,680,421 | 7/1987 | Forester et al. | 585/648 |
| 4,724,064 | 2/1988 | Reid | 108/48 |
| 4,962,264 | 10/1990 | Forester . | |
| 5,039,391 | 8/1991 | Reid et al. | 208/48 R |

FOREIGN PATENT DOCUMENTS

| | | | |
|---|---|---|---|
| 275662 | 8/1928 | United Kingdom | 208/48 |
| 296752 | 9/1928 | United Kingdom | 260/668 |

OTHER PUBLICATIONS

Chemical Abstracts: vol. 83:30687k 1975.
Chemical Abstracts: vol. 87:154474r 1977.
Chemical Abstracts: vol. 95:135651v 1981.
Chemical Abstracts: vol. 92:8645j 1980.

*Primary Examiner*—Paul Lieberman
*Assistant Examiner*—Mary C. DiNunzio
*Attorney, Agent, or Firm*—Alexander D. Ricci; Philip H. Von Neida

[57] ABSTRACT

Methods and compositions are provided for inhibiting the formation and deposition of pyrolytic coke on metal surfaces in contact with a hydrocarbon feedstock undergoing pyrolytic processing. Coke inhibition is achieved by adding a coke inhibiting amount of a combination of a boron compound and a dihydroxybenzene compound.

20 Claims, No Drawings

METHOD FOR INHIBITING COKE FORMATION AND DEPOSIITON DURING PYROLYTIC HYDROCARBON PROCESSING

FIELD OF THE INVENTION

The present invention is directed towards compositions and methods for inhibiting the formation and deposition of coke on metallic surfaces in contact with hydrocarbon feedstock which is undergoing high temperature pyrolytic processing. The compositions and methods employ a boron compound and a dihydroxybenzene compound to retard coke formation and deposition on metal surfaces in contact with the hydrocarbon which are in excess of 1600° F.

BACKGROUND OF THE INVENTION

Coke deposition is generally experienced when hydrocarbon liquids and vapors contact the hot metal surfaces of petroleum processing equipment. The complex makeup of the hydrocarbons at elevated temperatures and contact with hot metal surfaces makes it unclear what changes occur in the hydrocarbons. It is thought that the hydrocarbons undergo various changes through either chemical reactions and/or the decomposition of various unstable components of the hydrocarbons. The undesired products of these changes in many instances include coke, polymerized products, deposited impurities and the like. Regardless of the undesired product that is produced, reduced economies of the process is the result. If these deposited impurities remain unchecked, heat transfer, throughput and overall productivity are detrimentally effected. Moreover, downtime is likely to be encountered due to the necessity of either replacing the affected parts or cleaning the fouled parts of the processing system.

While the formation and type of undesired products is dependent on the type of hydrocarbon being processed and the operating conditions of the processing, it may generally be stated that such undesired products can be produced at temperatures as low as 100° F. However, the undesired products are much more prone to formation as the temperature of the processing system and the metal surfaces thereof in contact with the hydrocarbon increase. At these higher temperatures, coke formation is likely to be produced regard less of the type of hydrocarbon being charged. The type of coke formed, be it amorphous, filamentous or pyrolytic, may vary somewhat; however, the probability of coke formation is quite high.

Coke formation also erodes the metal of the system in two ways. The formation of catalytic coke causes the metal catalyst particle to become dislodged. This results in rapid metal loss and ultimately metal failure. The other erosive effect occurs when carbon particles enter the hydrocarbon stream and act as abrasives on the tube walls of the processing system.

As indicated in U.S. Pat. No. 4,962,264 which is herein incorporated by reference, coke formation and deposition are common problems in ethylene (olefin) plants which operate at temperatures of the metal surfaces are sometimes at 1600° F. and above. The problem is prevalent in the cracking furnace coils as well as in the transfer line exchangers (TLEs) where pyrolytic type coke formation and deposition is commonly encountered. Ethylene plants originally produced simple olefins such as ethylene, propylene, butene and butadiene from a feed of ethane, propane, butane and mixtures thereof. Later developments in this area of technology have led to the cracking of even heavier feedstocks to produce aromatics and pyrolysis gasoline as well as the light molecular weight olefins. Feed stocks now include kerosene light naphtha, heavy naphtha and gas oil. According to the thermal cracking processes utilized in olefin plants, the feedstocks are generally cracked in the presence of steam in tubular pyrolysis furnaces. The feedstock is preheated, diluted with steam and this mixture is then heated in the pyrolysis furnace to about 1500° F. and above, most often in the range 1500° F. to 1650° F.

The effluent from the furnace is rapidly quenched by direct means or in exchangers which are designed to generate steam at pressures of 400 to 800 psig. This rapid quench reduces the loss of olefins by minimizing any secondary reactions. The cooled gas then passes to a prefractionator where it is cooled by circulating oil streams to remove the fuel oil fraction. In some designs, the gas leaving the oil is further cooled with oil before entering the prefractionator. In either case, the heat transferred to the circulating oil stream is used both to generate steam and to heat other process streams. The mixture of gas and steam leaving the prefractionator is further cooled in order to condense the steam and most of the gasoline product in order to provide reflux for the prefractionator. Either a direct water quench or heat exchangers are used for this post prefractionator cooling duty.

After cooling, cracked gas at, or close to atmospheric pressure, is compressed in a multistage compression system to much higher pressures. There are usually four or five stages of compression with interstage cooling and condensate separation between stages. Most plants have hydrocarbon condensate stripping facilities. Condensate from the interstage knockout drum is fed to a stripper where the $C_2$ and lighter hydrocarbons are separated. The heavier hydrocarbons are fed to the depropanizer.

Accordingly, there is a need in the art to inhibit the formation and deposition of coke on surfaces in contact with high temperature hydrocarbons to improve the efficiencies of the processing system. Moreover, there is a particular need to retard coke formation and deposition during the high temperature pyrolysis and cracking of hydrocarbons.

GENERAL DESCRIPTION OF THE INVENTION

The present invention pertains to compositions and methods for inhibiting the formation and deposition of pyrolytic coke on the heated metal surfaces in contact with a hydrocarbon feedstock which is undergoing pyrolytic processing to produce lower hydro carbon fractions and said metal surfaces having a temperature of about 1600° F. or above, which method comprises adding to said hydrocarbon feedstock being processed a coke inhibiting amount of a combination of a boron compound and a dihydroxybenzene compound.

While the invention is applicable to any system where coke is produced, this invention is surprisingly effective during the high temperature pyrolysis and cracking of a hydrocarbon feedstock.

The present inventors have discovered an improved composition and method for inhibiting coke formation and deposition on metal surfaces in pyrolytic furnaces utilizing the preferred composition of ammonium biborate and hydroquinone.

DESCRIPTION OF THE RELATED ART

French Patent No. 2,202,930 (Chem. Abst. Vol. 83:30687k) is directed to tubular furnace cracking of hydrocarbons where molten oxides or salts of Group III IV or VIII metals (e.g., molten lead containing a mixture of $K_3VO_4$, $SiO_2$ and NiO) are added to a pretested charge of, for example, naphtha steam at 932° F. This treatment is stated as having reduced deposit and coke formation in the cracking section of the furnace.

Starshov et al., Izv. Vyssh. Uchebn. Zaved Neft Gaz, 1977 (Chem. Abst. 87:154474r) describes the pyrolysis of hydrocarbons in the presence of aqueous solutions of boric acid. Carbon deposits were minimized by this process.

Nokonov et al., U.S.S.R. No. 834,107, 1981; (Chem. Abst. 95: 13565v) describes the pyrolytic production of olefins with peroxides present in a reactor, the internal surfaces of which have been pretreated with an aqueous alcoholic solution of boric acid. Coke formation is not mentioned in this patent since the function of boric acid is to coat the inner surface of the reactor and thus decrease the scavenging of peroxide radicals by the reactor surface.

Starshov et al., Neftekhimiya 1979 (Chem. Abst. 92:8645j) describes the effect of certain elements including boron on coke formation during the pyrolysis of hydrocarbons to produce olefins.

U.S. Patent No 3,531,344 (Koszman) teaches the inhibition of carbon formation in the thermal cracking of petroleum fractions. His process teaches the use of bismuth and phosphorous containing compounds to reduce carbon formation.

U.S. Patent No. 3,661,820 (Foreman et al.) teaches a composition that is used as a coating for steel surfaces. This composition will prevent carburization in gas carburizing, pack carburizing and carbonitriding mediums. The composition taught is a boron compound selected from boric acid, boric oxide and borax; water soluble organic resin; carrier fluid of water and thickening and drying agents.

U.S. Patent No. 2,063,596 (Feiler) teaches a method of treating the metal of a system processing hydrocarbons at high temperatures. This patent discloses the suppression of the deposition of carbon on the metal surfaces of a hydrocarbon process using the metals tin, lead, molybdenum, tungsten and chromium to coat the metal surfaces. This patent conjectures as to the use of a metalloid of boron as a treating agent.

Great Britain 296,752 teaches a method of preventing deposition of coke or soot on metal surfaces in contact with hydrocarbons at high temperatures. The metals are treated directly with metalloids of boron, arsenic, bismuth, antimony, phosphorous or selenium.

Great Britain 275,662 teaches a process for preventing the formation of carbon monoxide in a hydrocarbon cracking operation. This process involves coating the metal surfaces that contact the hydrocarbon with metalloids of boron, arsenic, antimony, silicon, bismuth, phosphorous or selenium.

U.S. Pat. No. 1,847,095 (Mittasch et al.) teaches a process for preventing the formation and deposition of carbon and soot in hydrocarbon processes operating at elevated temperatures. This process consists of adding to the hydrocarbon stream hydrides of metalloids selected from the group of boron, arsenic, antimony, bismuth, phosphorous, selenium and silicon.

U.S. Pat. No. 3,687,840 (Sze et al.) teaches a method of stopping plugs in a delayed coker unit that result from the formation and deposition of coke. This process employs sulfur and sulfur compounds as the inhibiting agents.

U.S. Pat. No. 4,555,326 (Reid) teaches a method of inhibiting the formation and deposition of filamentous coke in hydrocarbon processing systems operating at high temperatures. The metal that contacts the hydrocarbon fluid is first treated ("boronized") by contacting it with boron, boron oxide compounds or metal borides.

U.S. Pat. No. 4,729,064 (Reid) teaches a method of inhibiting the formation and deposition of filamentous coke on metal surfaces in contact with a hydrocarbon fluid at high temperatures. Boron oxide compounds, metal borides and boric acid which is substantially free of water are the inhibiting agents.

U.S. Pat. No. 4,680,421 (Forester et al.) discloses a method of inhibiting the formation and deposition of pyrolytic coke on the heated metal surfaces of a pyrolysis furnace. This method employs an ammonium borate compound to inhibit the deposition on the 1600° F. and higher temperature metal surfaces.

U.S. Pat. No. 3,342,723 (Godar) teaches a method of inhibiting the formation and deposition of coke-like deposits and soft sludges on structural surfaces in contact with a hydrocarbon undergoing petroleum refining. This method utilizes an ortho substituted aromatic compound or substituted monocyclic compound such as catechol as the antifouling agent. This patent does not teach the synergistic composition of the present invention.

DETAILED DESCRIPTION OF THE INVENTION

The present invention pertains to compositions and methods for inhibiting the formation and deposition of pyrolytic coke on the heated metal surfaces in contact with a hydrocarbon feedstock which is undergoing pyrolytic processing to produce lower hydrocarbon fractions and said metal surfaces having a temperature of about 1600° F. or higher, which improvement comprises the method of adding to said hydrocarbon feedstock being pyrolytically processed a coke inhibiting amount of a combination of a boron compound and a dihydroxybenzene compound.

The compositions and methods of this invention are surprisingly effective coke retardants at the high temperatures of the metal surfaces of the pyrolytic furnace, reaching temperatures of 1400° F. and up to 2050° F. These temperatures are commonly encountered in olefin plants where hydrocarbon feedstocks containing ethane, propane, butane, light naphtha, heavy naphtha, gas oil, and mixtures of the same are cracked to produce lower and/or olefinic hydrocarbon fractions. Coking is a significant problem for if it is left untreated, the operation will eventually shut down.

In these pyrolysis systems, the components of the pyrolytic furnace, as well as the ancillary parts are composed of ferrous metal. Iron, as well as iron alloys such as low and high carbon steel, and nickel-chromium-iron alloys are customarily used for the production of hydrocarbon and petroleum processing equipment such as furnaces, transmission lines, reactors, drums, heat exchangers, fractionators, and the like.

It has been found that during the high temperature pyrolytic processing of hydrocarbons coke will form and deposit on the stainless steel surfaces of the system.

This formation and deposition on the stainless steel surfaces can be significantly reduced in accord with the test herein by use of a composition of a boron compound and a dihydroxybenzene compound, specifically ammonium biborate and hydroquinone.

Accordingly, it is to be expected that coke formation will also be reduced on iron, chromium and nickel based metallurgical surfaces in contact with pyrolysis products in high temperature pyrolytic furnaces.

The boron compounds are effective when formulated with glycollic-type solvents, in particular ethylene glycol, propylene glycol, glycerol, hexylene glycols and polyethylene glycols.

The present inventors anticipate that boron oxide, ammonium pentaborate and sodium borate will be effective compounds in the instant invention.

The dihydroxybenzene compounds are effective when formulated in water with a co-solvent such as butyl carbitol or ethylene glycol.

The present inventors anticipate that resorcinol, catechol, 1, 2-naphthoquinone, 1,4-naphthoquinone, 1,4-naphthoquinone and 4-tert-butyl-resorcinol will be effective dihydroxybenzene compounds in the instant invention.

The boron compounds and dihydroxybenzene compounds are formulated separately. The mixtures can then be added directly to the hydrocarbon feedstock or charge before and/or during the pyrolytic processing, or the treatment composition may be mixed with steam carried to the cracking zone in accordance with conventional cracking techniques.

The treatment dosages for the boron compounds and the dihydroxybenzene compounds are dependent upon the severity of the coking problem, location of such problem, and the amount of active compound in the formulated product. For this reason, the success of the treatment is totally dependent upon the use of a sufficient amount of the treatment composition thereby to effectively inhibit coke formation and deposition.

Preferably, the total amount of boron compound added is from about 1 ppm to about 2500 ppm per million parts of feedstock. The dihydroxybenzene compound added is from about 1 ppm to about 2500 ppm per million parts of feedstock.

More preferably, the boron compound ranges from about 10 ppm to about 250 ppm and the dihydroxybenzene from about 20 ppm to about 500 ppm per million parts of feedstock.

The preferred weight ratio of the preferred embodiment (Hydroquinone:Ammonium Biborate) ranges from 1:1 to 4:1, most preferably 2.6:1. The preferred embodiment employs a 35 weight percent ammonium biborate in ethylene glycol and a 20 weight percent hydroquinone in ethylene glycol combination.

The invention will now be further described with reference to a number of specific examples which are to be regarded solely as illustrative, and not as restricting the scope of the invention.

EXAMPLES

In order to establish the efficacy of the invention, various tests were conducted using a propane feedstock with dilution steam added to enhance cracking. The apparatus and procedure used for the testing were as follows:

Apparatus

The high temperature fouling apparatus (HTFA) consists of five subsections which together simulate the pyrolysis of gaseous hydrocarbons to make the light olefinic end products and the undesirable by-product, coke, that is formed on the heated metal surfaces during the pyrolysis reaction.

The feed preheat section is built of 316 stainless steel tubing and fittings and allows the mixing of nitrogen or oxygen containing gas with steam during the start up and shut down of the HFTA and the propane with steam during the actual test. Steam is supplied at 40 psig by a steam generator and nitrogen, oxygen containing gas, or propane is fed from compressed gas cylinders. The gases and steam are heated to about 300° F. at which point small amounts of water (blank test) or candidate material is slowly injected into the stream by a syringe pump. The gases/candidate material are further preheated to about 500° F. before flowing through a 13-foot long coiled 316 SS tube inside an electrically heated furnace. The gases are heated at a furnace temperature of approximately 188° F. and exit the furnace at 1150°-1450° F.

Following the furnace tube, the gases travel through the coker rod assembly. This consists of a 316 SS rod which is electrically heated to 1500° F. while the gases flow around the heated rod inside a 316 SS shell. The rod is electrically heated through a silicon controlled rectifier (SCR), then through two 4 to 1 stepdown transformers in series to achieve low voltage (3–4 volts) and high amperage (200 amps) heating of the rod. A temperature controller is used to achieve power control through the SCR to obtain a 1500° F. rod temperature.

Upon exiting the coker rod, the gases pass through a condenser coil and then through three knock-out flasks in ice baths to remove the water (steam) from the product gases.

The small amount of remaining entrained water vapor in the gases is removed by passing through drierite granules.

The specific gravity of the product gas is determined in a gas densitometer and the gases are analyzed using gas chromotography to determine yields. The remaining gases are vented through a safety hood exhaust.

Test Procedure

The furnace was turned on and the temperature thereof was stabilized at 1300° F. while feeding nitrogen and steam. The coker rod was heated to 1500° F. The nitrogen was replaced with oxygen containing gas (air) and furnace temperatures were then slowly increased to 1500° F. over a period of ten minutes. Then the air was replaced with nitrogen and the coke inhibitor or water (blank), as the case may be, was injected into the mixed gas or steam line at about 300° F. gas temperature while the furnace temperature was slowly raised to 1880° F. over 20–25 minutes.

Then the nitrogen feed was gradually switched to propane feed over about 5 minutes. The temperature of the furnace dropped due to the propane cracking reaction and was allowed to increase to the maximum attainable furnace temperature (1880° F. or less) over approximately a 30 minute period. The product gases were analyzed by gas chromatography and the temperatures, flowrates, pressures and product gas gravity recorded every 35 minutes during the 160 minute test on propane/steam feed. Gases exit the furnace tube at about 1150° F.-1450° F. and exit the coker shell at about 975° F.-1000° F. temperatures.

During a normal 160 minute run, approximately 3200-3300 grams of propane were fed and 1000-2000 grams of steam fed (determined from the condensate collected) for hydrocarbon to steam rates of about 1.6:1 to 3.2:1. Following shutdown and cooling, the furnace tube and coker shell were cleaned and the coke collected and weighed. The collected coke was then burned in air at 1400° F. for one hour and the residue remaining weighed and termed gray matter (corrosion products from furnace tube).

Table I reports the results of the above test by indicating the amount of coke formed for various antifoulants. A high percentage coke reduction value is indicative of effective treatment.

TABLE I

High temperature fouling apparatus (HFTA)
Results for coke inhibiting compounds
1300°-1500° F. furnace steam/air decoke
1500°-1870° F. furnace antifoulant/$N_2$/steam
1870° F. furnace propane (0.5 SCFM)/steam/antifoulant for 160 minutes

| Additive | No. of Runs | Ave % Coke Reduction |
|---|---|---|
| Blank | 18 | −3 |
| 10% HQ/23.33% AmBiBor in EG | 5 | 70 |

HQ = Hydroquinone
AmBiBor = Ammonium Biborate
EG = Ethylene Glycol

The inventive composition was evaluated as a pretreatment agent to determine the amount of coke deposited. 20 ml of the treating agent was injected into the steam line of the HFTA over two hours and allowed to flow through the furnace tube and coker rod heated to 1500° F. Following this pretreatment, the tube and rod were removed and weighed. The tube and the rod were then reassembled and a blank propane/steam run was conducted on the pretreated surfaces. The results of these pretreated HFTA tests are shown in Table II.

TABLE II

High temperature fouling apparatus (HFTA)
Results for coke inhibiting compounds
2 hour pretreatement at 1500°-1870° F.
furnace propane (0.5 SCFM)/steam for 160 minutes

| Additive | Metal (ppm) | Coke Level (Grams) |
|---|---|---|
| Blank | | 3.05, 2.14, 1.11 2.1 avg. |
| 10% HQ/23.33% AmBiBor in EG | 608 HQ 223 B | 0.34 |

HQ = Hydroquinone
AmBiBor = Ammonium Biborate
EG = Ethylene Glycol

The results of Table II indicate that the inventive composition is effective at inhibiting the deposition of coke in pyrolytic furnaces both as a pretreatment agent and as a treatment agent during hydrocarbon processing.

The following data was generated by employing 310 stainless steel furnace tube and coker rod. The coke formed during the propane/steam/antifoulant run was burned off and the levels of CO and $CO_2$ was monitored. These results appear in Tables III and IV.

TABLE III

High Temperature Fouling Apparatus (HTFA)
1870° F. Furnace, Propane (0.5 SCFM)/Steam/Antifoulant
310 Stainless Steel Metallurgy Furance Tube and Coker Rod

| Run No. | Additive (ppm) in EG | Steam Rate (ml/min) | Time on Propane (min) | Coke Value[1] | Predicted Coke Value[2] | % Change in Coking vs. Predicted[3] |
|---|---|---|---|---|---|---|
| 1 | Blank | 8.95 | 279 | 2.01 | 2.48 | −19 |
| 4 | Blank | 7.34 | 300 | 3.30 | 2.69 | 23 |
| 9 | Blank | 7.28 | 300 | 3.91 | 3.70 | 6 |
| 14 | Blank | 6.58 | 316 | 4.28 | 4.56 | −6 |
| 3 | HQ(240) AmBiBor(92) | 7.06 | 294 | 1.73 | 2.41 | −28 |
| 6 | HQ(457) AmBiBor(25) | 6.13 | 300 | 2.58 | 2.79 | −7 |
| 7 | HQ(443) AmBiBor(24) | 6.27 | 234 | 2.35 | 3.03 | −23 |
| 8 | HQ(237) AmBiBor(91) | 6.97 | 300 | 2.89 | 3.42 | −15 |
| 13 | HQ(410) AmBiBor(23) | 7.00 | 332 | 2.89 | 4.46 | −35 |
| 10 | HQ(585) | 7.60 | 301 | 5.90 | 3.99 | 48 |

$CO_2$ and CO Measurements

| Run No. | $CO_2$ Area | CO Area | Resid. Coke |
|---|---|---|---|
| 1 | 4.4 | 0.39 | 0.37 |
| 4 | 8.6 | 2.04 | 0.08 |
| 9 | 14 | 6.8 | 3.85 |
| 14 | 6.8 | 3.85 | 0.77 |
| 3 | 5.7 | 0.27 | 0.06 |
| 6 | 7.0 | 1.39 | 0.08 |
| 7 | 6.2 | 1.30 | 0.09 |
| 8 | 8.1 | 1.41 | 0.07 |
| 13 | 8.0 | 1.00 | 0.29 |

TABLE III-continued

| High Temperature Fouling Apparatus (HTFA) 1870° F. Furnace, Propane (0.5 SCFM)/Steam/Antifoulant 310 Stainless Steel Metallurgy Furance Tube and Coker Rod | | | |
|---|---|---|---|
| 10 | 11.9 | 6.03 | 0.06 |

[1]Coke value = $CO_2$ * 0.273 + CO × 0.429 + coke resid.
[2]Predicted coke value = 0.206 × Run No. + 0.254 × steam rate
[3]% Change in coking = [(Coke Value − Predicted Coke value)/predicted coke value] × 100
HQ = Hydroquinone
AmBiBor = Ammonium Biborate
EG = Ethylene Glycol

TABLE IV

High Temperature Fouling Apparatus (HTFA)
1870° F. Furnace, Propane (0.5 SCFM)/Steam/Antifoulant
Inconel 800 Metallurgy Furnace Tube

| Run No. | Additive (ppm) in EG | Steam Rate (ml/min) | Time on Propane (min) | Coke Value[1] | Predicted Coke Value[2] | % Change in Coking vs. Predicted[3] |
|---|---|---|---|---|---|---|
| 1 | Blank | 7.54 | 300 | 8.86 | 8.0 | 11 |
| 4 | Blank | 6.08 | 300 | 10.10 | 12.2 | −17 |
| 8 | Blank | 6.81 | 271 | 21.00 | 20.0 | 5 |
| 5 | HQ(213) AmBiBor(82) | 7.31 | 300 | 5.06 | 15.0 | −66 |
| 6 | HQ(211) AmBiBor(81) | 7.04 | 298 | 9.70 | 16.6 | −42 |
| 11 | HQ(387) AmBiBor(148) | 7.11 | 310 | 4.75 | 25.7 | −82 |
| 7 | HQ(632) | 6.52 | 296 | 34.71 | 18.0 | −93 |
| 2 | AmBiBor(120) | 7.60 | 300 | 23.56 | 9.9 | 139 |
| 3 | AmBiBor(62) | 7.59 | 298 | 31.60 | 11.7 | 171 |
| 9 | AmBiBor(209) | 6.80 | 304 | 1.22 | 21.8 | −94 |
| 10 | AmBiBor(51) | 7.20 | 300 | 18.06 | 24.0 | −25 |

$CO_2$ and CO Measurements

| Run No. | $CO_2$ Area | CO Area | Resid. Coke |
|---|---|---|---|
| 1 | 17.67 | 3.39 | 2.59 |
| 4 | 22.80 | 5.97 | 1.32 |
| 8 | 48.81 | 12.36 | 2.39 |
| 5 | 10.66 | 4.07 | 0.41 |
| 6 | 18.58 | 7.73 | 1.32 |
| 11 | 7.22 | 4.07 | 0.15 |
| 7 | 79.40 | 24.52 | 2.55 |
| 2 | 61.43 | 12.50 | 1.45 |
| 3 | 80.30 | 18.42 | 1.80 |
| 9 | 2.44 | 0.85 | 0.19 |
| 10 | 41.52 | 13.12 | 1.11 |

[1]Coke value = $CO_2$ × 0.273 + CO × 0.429 + resid coke.
[2]Predicted coke value = 1.81 × Run Number + 0.82 × steam rate
[3]% Change in coking = [(Coke Value − Predicted Coke value)/predicted coke value] × 100
HQ = Hydroquinone
AmBiBor = Ammonium Biborate
EG = Ethylene Glycol As seen in Tables III and IV, the inventive composition reduced coke formation by 21.6% and 63.3% respectively. Hydroquinone and ammonidum biborate when employed by themselves were less effective.

Accordingly, from the above, it is clear that a combination of hydroquinone and ammonium biborate is effective as a coke retarding treatment under the simulated pyrolysis conditions above noted.

While this invention has been described with respect to particular embodiments thereof, it is apparent that numerous other forms and modifications of this invention will be obvious to those skilled in the art.

Having thus described the invention what we claim is:

1. A method for inhibiting the formation and deposition of coke on the heated metal surfaces in contact with a hydrocarbon feedstock which is undergoing pyrolytic processing to produce lower hydrocarbon fractions and said metal surfaces having a temperature of about 1600° F. or higher, which improvement comprises adding to said hydrocarbon feedstock being pyrolytically processed a coke inhibiting amount of a synergistic combination of a boron compound and a dihydroxybenzene compound.

2. A method as claimed in claim 1 wherein said boron compound is an ammonium borate.

3. A method as claimed in claim 2 wherein said ammonium borate is ammonium biborate.

4. A method as claimed in claim 2 wherein said ammonium borate is ammonium pentaborate.

5. A method as claimed in claim 1 wherein said boron compound is boron oxide.

6. A method as claimed in claim 1 wherein said boron compound is sodium borate.

7. A method as claimed in claim 1 wherein said dihydroxybenzene compound is hydroquinone.

8. A method as claimed in claim 1 wherein said dihydroxybenzene compound is resorcinol.

9. A method as claimed in claim 1 wherein said dihydroxybenzene compound is catechol.

10. A method as claimed in claim 1 wherein said dihydroxybenzene compound is 1,2-naphthoquinone.

11. A method as claimed in claim 1 wherein said dihydroxybenzene compound is 4-tert-butyl resorcinol.

12. A method as claimed in claim 1 wherein said boron compound is contained in a glycollic carrier.

13. A method as claimed in claim 12 wherein said glycollic carrier is ethylene glycol.

14. A method as claimed in claim 1 wherein said dihydroxybenzene compound is contained in a water:-butyl carbitol co-solvent carrier.

15. A method as claimed in claim 1 wherein said dihydroxybenzene compound is contained in a water-:ethylene glycol co-solvent carrier.

16. A method as claimed in claim 1 wherein said boron compound is added to the hydrocarbon feedstock from about 1 ppm to about 2500 ppm per million parts of hydrocarbon feedstock.

17. A method as claimed in claim 1 wherein said dihydroxybenzene compound is added to the hydrocarbon feedstock from about 1 part per million to about 2500 parts per million per million parts of hydrocarbon feedstock.

18. A method as claimed in claim 1 wherein said coke formed is pyrolytic coke.

19. A method as claimed in claim 1 wherein said hydrocarbon feedstock is ethane, propane, butanes, light naphtha, heavy naphtha, gas oil or mixtures of same.

20. A method as claimed in claim 1 wherein said metal surface is a ferrous metal.

* * * * *